US009993044B2

(12) United States Patent
Garcia

(10) Patent No.: US 9,993,044 B2
(45) Date of Patent: Jun. 12, 2018

(54) HELMET WITH EYE PROTECTION

(71) Applicant: Adolfo Nava Garcia, Watsonville, CA (US)

(72) Inventor: Adolfo Nava Garcia, Watsonville, CA (US)

( * ) Notice: Subject to any disclaimer, the term of this patent is extended or adjusted under 35 U.S.C. 154(b) by 303 days.

(21) Appl. No.: 13/691,572

(22) Filed: Nov. 30, 2012

(65) Prior Publication Data

US 2013/0219599 A1 Aug. 29, 2013

Related U.S. Application Data

(60) Provisional application No. 61/604,292, filed on Feb. 28, 2012.

(51) Int. Cl.
*A42B 3/22* (2006.01)

(52) U.S. Cl.
CPC ..... *A42B 3/22* (2013.01); *A42B 3/226* (2013.01)

(58) Field of Classification Search
CPC .... A42B 3/14; A42B 3/18–3/24; A42B 3/226; A43B 3/226
USPC .... 2/6.4, 6.5, 10, 416, 424, 8.1–8.5, 8.6, 6.3
See application file for complete search history.

(56) References Cited

U.S. PATENT DOCUMENTS 1,416,848 A * 5/1922 Lightfield ..... A61F 9/061 2/10
2,017,059 A * 10/1935 Gingg ..... A61F 9/065 2/8.7
2,277,090 A * 3/1942 Feiler ..... A61F 9/025 2/8.1
2,411,224 A * 11/1946 O'Reilly ..... A61F 9/061 2/8.3
2,417,883 A * 3/1947 Oschin ..... A61F 9/062 2/8.4
2,548,230 A * 4/1951 Molyneux ..... A61F 9/062 2/432
2,556,433 A * 6/1951 Mitchell ..... G02C 7/16 2/432
2,798,221 A * 7/1957 Bailey ..... A42B 3/228 2/10
2,815,508 A * 12/1957 Finken ..... A42B 3/225 2/424
3,086,213 A * 4/1963 Crozat ..... A61F 9/061 2/8.3
3,159,844 A * 12/1964 Haboush ..... A61F 9/062 2/8.4
3,181,532 A * 5/1965 Harris ..... 128/201.23
3,293,659 A * 12/1966 Shepard ..... A42B 3/28 128/201.15
3,371,979 A * 3/1968 Catanzaro ..... G02C 7/12 351/49
3,413,656 A * 12/1968 German et al. ..... 2/412
3,444,561 A * 5/1969 Boyer ..... A61F 9/06 2/441
3,475,765 A * 11/1969 Zeltmann ..... A61F 9/022 2/8.4
3,487,470 A * 1/1970 Stapenhill ..... A42B 3/226 2/6.4

(Continued)

*Primary Examiner* — Jillian K Pierorazio

(57) ABSTRACT

An apparatus comprising an outer shell is described. The outer shell is rotatable around an internal framework coupled with the outer shell. A guide track is also disclosed such that the guide track is coupled with an outer shell. Also, an eye shield is disclosed such that the eye shield may deploy out of and retract into the guide track.

6 Claims, 4 Drawing Sheets

(56) References Cited

U.S. PATENT DOCUMENTS 3,495,273 A * 2/1970 Aileo ..... 2/6.4
3,601,813 A * 8/1971 Aileo ..... 2/410
3,743,381 A * 7/1973 Moodie ..... B64C 1/1484 359/489.2
3,838,913 A * 10/1974 Schwarz ..... A61F 9/022 351/47
3,943,573 A * 3/1976 Budmiger ..... A61F 9/06 2/432
3,963,021 A * 6/1976 Bancroft ..... A62B 18/045 128/201.25
4,012,794 A * 3/1977 Nomiyama ..... 2/411
4,015,294 A * 4/1977 O'Neill ..... B63C 11/06 2/421
4,047,249 A * 9/1977 Booth ..... A42B 3/226 2/10
4,071,912 A * 2/1978 Budmiger ..... A61F 9/067 2/8.8
4,153,952 A * 5/1979 Dussich ..... A61F 9/062 2/12
4,172,294 A * 10/1979 Harris ..... A62B 18/04 2/171.3
4,227,520 A * 10/1980 Lord ..... 128/201.24
4,239,352 A * 12/1980 Dockal ..... 351/57
4,649,571 A * 3/1987 Falkiner ..... A61F 9/064 2/432
4,679,255 A * 7/1987 Kuhlman ..... A61F 9/061 2/8.3
4,887,320 A * 12/1989 Long ..... A42B 3/226 2/424
4,937,879 A * 7/1990 Hall ..... A61F 9/061 2/8.3
5,012,528 A * 5/1991 Pernicka ..... A42B 3/225 2/10
5,163,185 A * 11/1992 Hodnett ..... A42B 3/26 2/422
5,224,219 A * 7/1993 Edwards ..... A61F 9/061 2/8.3
5,291,880 A * 3/1994 Almovist ..... A62B 18/084 128/201.22
5,353,437 A * 10/1994 Field ..... A41D 13/0153 2/421
5,500,953 A * 3/1996 Reuber ..... A42B 3/226 2/15
5,669,070 A * 9/1997 Bennett ..... A61F 9/064 2/8.5
5,813,049 A * 9/1998 Xu ..... A61F 9/06 2/410
6,006,366 A * 12/1999 Vondrak ..... A42B 3/226 2/10
6,151,711 A * 11/2000 Edwards ..... A61F 9/061 2/8.3
6,185,739 B1 * 2/2001 Verkic ..... A61F 9/06 2/8.1
6,309,065 B1 * 10/2001 Marchione ..... A61F 9/022 2/432
6,374,823 B1 * 4/2002 Hajianpour ..... A62B 17/04 128/201.22
6,401,244 B1 * 6/2002 Kramer ..... A61F 9/06 2/8.1
6,804,829 B2 10/2004 Crye et al.
6,944,887 B2 * 9/2005 Heine ..... A42B 3/226 2/12
8,776,263 B1 * 7/2014 Fitos ..... A61F 9/062 2/8.3
8,990,963 B2 * 3/2015 Matthews ..... A61F 9/061 2/8.2
9,271,871 B2 * 3/2016 Wright ..... A61F 9/064
2010/0132085 A1 * 6/2010 Beaudet ..... A42B 3/221 2/6.5
2011/0271429 A1 * 11/2011 Nakayama ..... A42B 3/225 2/424
2011/0277224 A1 * 11/2011 Okuma et al. ..... 2/424
2012/0047637 A1 * 3/2012 Arnold ..... A42B 3/226 2/424

* cited by examiner

HELMET WITH EYE PROTECTION

RELATED UNITED STATES PATENT APPLICATION

This application claims priority to and benefit of U.S. Patent Application No. 61/604,292 filed on Feb. 28, 2012 entitled "Eye Protection in Helmet" by Adolfo Garcia.

BACKGROUND

Helmets for protection of the head of a user are commercially available in various embodiments. Some helmets are designed for construction workers. Typically, these helmets comprise an outer shell made of a resilient polymer and an internal framework for interfacing with the head of a user, and providing space between an outer shell and the internal framework.

BRIEF DESCRIPTION OF THE DRAWINGS

The accompanying drawings, which are incorporated in and form a part of this specification, illustrate and serve to explain the principles of embodiments in conjunction with the description. Unless specifically noted, the drawings referred to in this description should be understood as not being drawn to scale.

DESCRIPTION OF EMBODIMENTS

Reference will now be made in detail to various embodiments, examples of which are illustrated in the accompanying drawings. While the subject matter will be described in conjunction with these embodiments, it will be understood that they are not intended to limit the subject matter to these embodiments. Furthermore, in the following description, numerous specific details are set forth in order to provide a thorough understanding of the subject matter. In other instances, well-known methods, procedures, and objects, have not been described in detail as not to unnecessarily obscure aspects of the subject matter.

Workers in different disciplines, including construction, require helmets for protection, and also require eye protection not typically provided by commercially-available helmets. Eye guards and shields are typically provided separately, and may be interfaced with the user by straps wrapped around the head of a user and buckling or fastening behind. In one embodiment, straps may stretchable/flexible to hold the shield to a face of a user.

In various embodiments discussed herein, at least one eye shield is provided integrated with a helmet such that the shield may retract into a space between the outer shell of the helmet and an internal framework, and selectively deployed as desired by the user.

Figure 1:
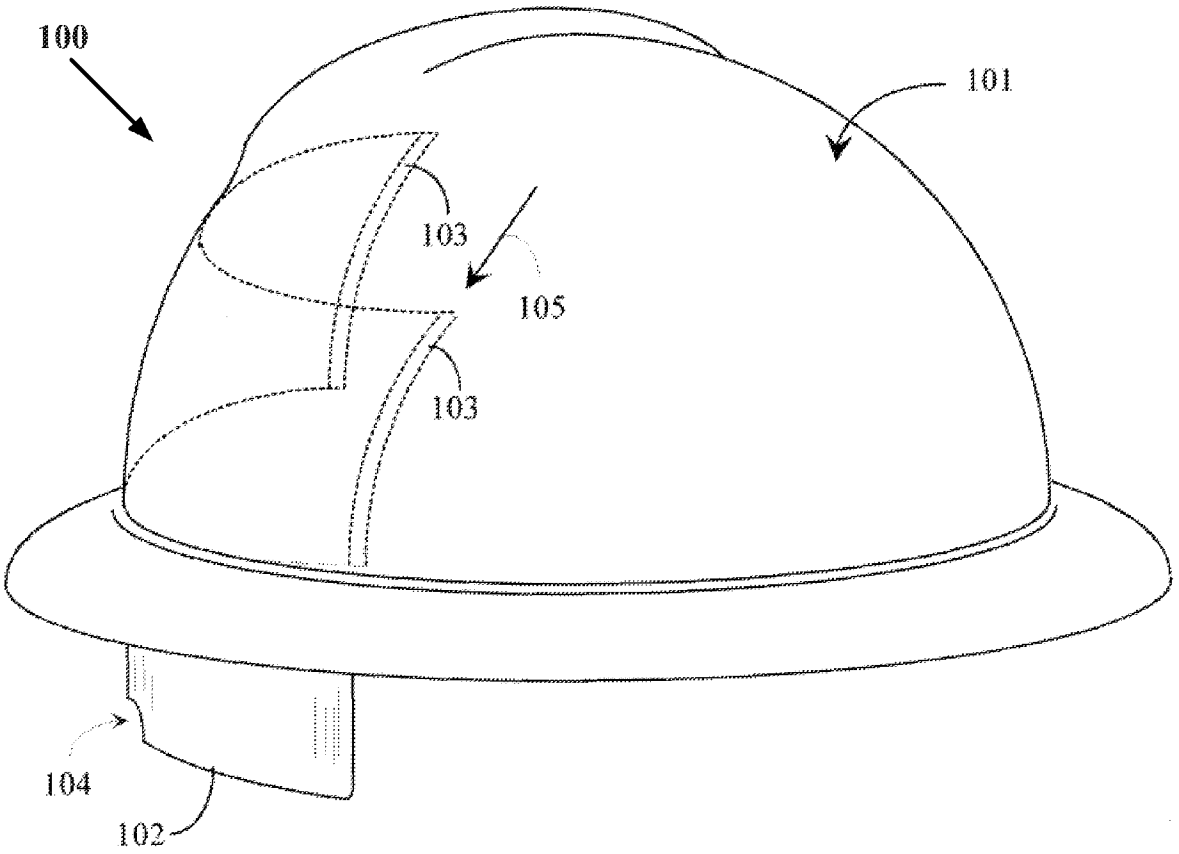
FIG. 1 is a diagram of an example helmet, in accordance with one embodiment.

FIG. 1 illustrates a molded helmet 100 in an embodiment. Helmet 100 comprises an outer shell 101 that, in various embodiments, is molded from high-strength polymer material and comprises an internal framework 303 (of FIG. 3; e.g., an internal web structure) that interfaces with the head of a user. When the helmet 100 is in place, there is a positive space all around the head of a user to the inner surface of the molded polymer material of the helmet shell 101. In various embodiments, this space is used to provide a retractable volume for at least one eye shield 102, which may be deployed downward to protect the eyes of a user, or upward into the helmet 100.

In various embodiments, eye shield 102 may be secured at various positions. For instance, eye shield 102 may be deployed one-quarter, half-way, or three-quarters of the way down (i.e., from full deployment). Helmet shell 101 or guides 103 may be used to control whether how far down a shield may deploy. Thus, if a user desires shield 102 to only deploy half way, a securing mechanism is in place such that the shield stays in place while half-way deployed.

In one embodiment, plastic eye shield 102 is transparent. In some instances, eye shield 102 has a clearance cut-out 104 for the nose of a user, is guided along its outside vertical edges in guide tracks 103, wherein guide tracks 103 are molded into or fastened to the inner surface of the helmet shell. Guide tracks 103 each have a groove 201 (of FIG. 2C) to accept and guide the eye shield 102 when deployed or retracted into the helmet 101. In one embodiment, eye shield 102 is molded or otherwise formed of high-strength transparent polymer material for eye shields 102. It should be noted that an eye shield 102 need not be transparent or plastic. In some embodiments and eye shield 102 is tinted.

In various embodiments, eye shield 102 is made of a material other than plastic. In some embodiment eye shield 102 is made from a material including, but not limited to: glass, polymers, a polarized material, lead, etc. In some embodiments the shield is made of a material to prevent ultraviolet radiation. In some embodiments, shield 102 may be designed for a specific user by an optometrist (i.e., the eye shield 102 may comprise distinct optical powers), in a fashion similar to prescription eye glasses or prescription sun glasses. In some embodiments, the shield 102 may have multiple optical powers in a manner similar to bifocals.

Figure 2A:
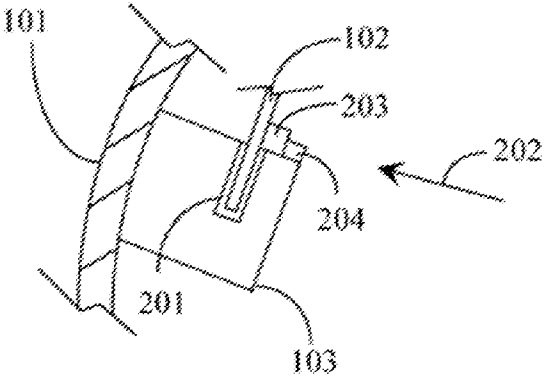
FIGS. 2A-2C are diagrams of example helmets with shields, in accordance with one embodiment.

FIG. 2A is shown from the perspective of arrow 105 in FIG. 1. FIG. 2A is an example diagram of a helmet 100 comprising an eye shield 102, and guide tracks 103. Guide tracks 103 have a groove 201 for accepting and guiding a vertical edge of eye shield 102. Guide track 103 is shown curved on one side to interface with the internal curvature of the inner wall of the helmet shell. Guide track 103 is also curved in the vertical direction to lie along the inner wall of the helmet shell to retain and guide the eye shield 102 to retract into the space between the head of a user and the inner wall of a helmet shell. A matching guide track 103 is fastened to the helmet at another position, such that an eye shield 102 guided in the opposed guide tracks 103 will deploy downward to cover the eyes of a user. In one embodiment, downward deployment is performed by a user grasping the lower edge of the eye shield 102 and pulling downward.

Figure 2B:
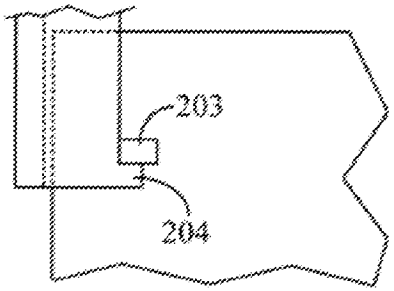

FIG. 2B is shown from the perspective of arrow 202 in FIG. 2A. In one embodiment, guide tracks 103 are closed at the upper end to provide a positive upper limit to upward translation of the eye shield 102 in refraction. In one embodiment, guide tracks 103 have a shelf-like projection 204 at or near the lower end, to engage an added piece 203 to limit the downward translation of the eye shield 102 in deployment, such that the eye shield 102 is properly positioned when deployed and does not come out of the guide tracks 103. In an embodiment, guide tracks 103 are glued or otherwise fastened to eye shield 102.

Figure 2C:
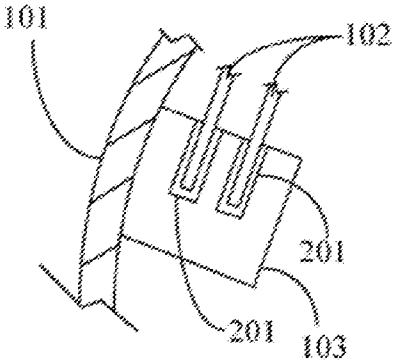

FIG. 2C shows an embodiment wherein two separate eye shields 102 (e.g., a pair of eye shields 102) may be engaged and guided in one guide track 103 arrangement. FIG. 2C shows an embodiment employing two grooves 201 in each of the guide tracks 103. In one embodiment, one eye shield 102 is tinted for extra protection from bright light (e.g., sunlight, welding, etc.). In one embodiment one eye shield 102 is clear. In various embodiments, eye shields 102 may be deployed separately or together.

There are a variety of ways that an eye shield 102 may be guided and retained. Moreover, there are a variety of ways that guide tracks 103 and enclosures within a helmet 100 may be implemented. Similarly, there are a variety of ways that upward and downward limits to movement in deployment and retraction may be performed. In one embodiment, guide tracks 103, the helmet shell 101, and/or the internal framework 303 may be fitted with a shock absorbing material such that the shield 102 does not cause discomfort and/or is less likely to break. In an embodiment, shock absorbing padding may be inflatable and/or adjustable. For instance, a pump may be used to inflate the padding. In one example, padding may have an adhesive such that a user may move the padding to other parts of the helmet or remove it.

In one embodiment, eye shield 102 is also a display device and provides for augmented reality. For example, additional information may be held in memory within the helmet 100 which is then shown on the eye shield 102. In some embodiments, the augmented reality may show a user instructions, such as instructions related to the tree service industry. For example, helmet 100 may comprise a processor and memory that is capable of providing a user with audio and/or visual information such as instructions. Instructions may include, but are not limited to: showing a user which plant/tree to remove, where to cut, where to plant, areas to stay away from, places to mark for future work, etc. In some embodiments, helmet 100 may further comprise a microphone and speakers. For example, a plurality of users may be able to communicate via helmet 100. This may reduce the need for cumbersome radios used by workers in the field. In addition, in some embodiments, helmet 100 may be coupled with a camera and/or a transceiver to send and receive data.

In some embodiments eye shield 102 comprises means for removing debris or water that may obscure the vision of a user. For instance, eye shield 102 may comprise a windshield wiper. In some embodiments, the outer portion of eye shield 102 may be covered by thin sheets of clear material that may be removed to assist with visability. In some embodiments, these sheets of plastic may be removed automatically at particular intervals. For instance, a roll of plastic (or some other transparent material) may be coupled with helmet 100, wherein a portion covers shield 102. At periodic intervals, the roll of transparent material automatically unrolls such that clean material covers at least a portion of eye shield 102 while the dirty material that was covering eye shield 102 is either cut off or moved into a separate container for collecting used material.

Figure 3:
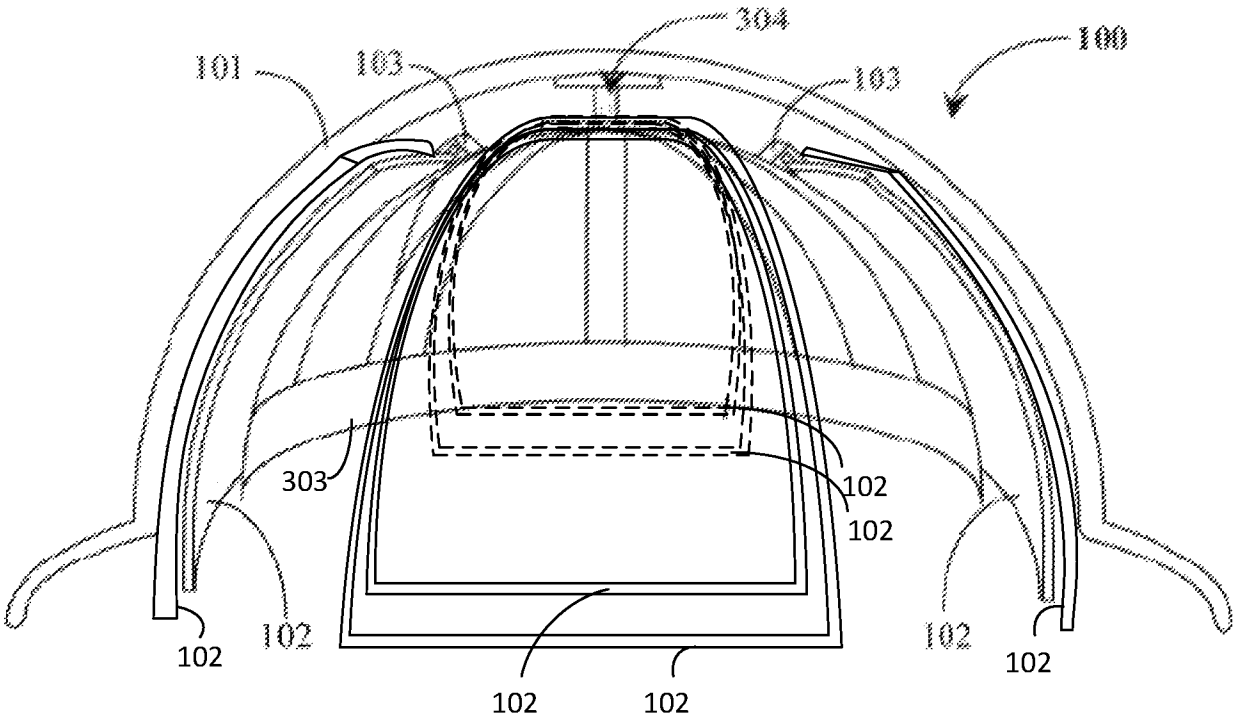
FIG. 3 is a diagram of an example helmet with an internal framework, in accordance with one embodiment.

In one embodiment, a helmet shell may be constructed such that it is rotatable about an internal framework 303 (e.g., a web structure) for interfacing with the head of a user. FIG. 3 shows a cross-section of a helmet 100 comprising an outer shell 101 and an internal framework 303 (e.g., a web structure, a stretchable band, etc.). In an embodiment, the internal framework 303 and the outer shell 101 are joined at the top by a pivoting mechanism 304, such that when the inner framework 303 is engaged to the head of a user the outer shell 101 may be rotated about the head of a user. In an embodiment, as shown in FIG. 3, two eye shields 102 are opposite one another in a helmet shell 101. Each eye shield 102 is shown guided by a guide track 103 (the second guide track is not shown in FIG. 3, although it is included in some embodiments). In some embodiments, four eye shield 102 positions may be implemented in such an arrangement. In an embodiment, a user may rotate the outer shell 101 to reposition eye shields 102. For instance, an eye shield 102 in the front of a helmet 100 may be clear, while an eye shield in the back, or on the side of a helmet may be tinted. In one embodiment, with one eye shield 102 deployed in front of the face of a user, shields 102 at the sides and the back may also be deployed to shield and protect the sides of the face, ears, and back of the neck of a user. In an embodiment this protects a user from flying debris.

In an embodiment, the outer shell is secured at particular positions. For instance, pivoting mechanism 304 may comprise a locking/securing mechanism that allows the rotatable helmet to be secure at various positions around the head of a user. This way, a user will not need to worry about the rotatable shell continuing to rotate about their head. In such an embodiment, the shell will stay in place without rotating unless the user forces it to. For instance, the rotating helmet may contain a fastener such as a clip or a switch which may or may not be connected to the pivot mechanism 304 to prevent the helmet from rotating.

In one embodiment, there may be a pair of eye shields 102 (e.g., dual eye shields) at each position around a helmet. In various embodiments, shields 102 may be tinted, of various thicknesses, and comprise other variations. With four positions with two deployable shields 102 each, a user may deploy eight shields 102. In some embodiments, sliding standoff elements may be implemented around the periphery of a helmet shell 101 to engage the internal framework 303 and provide additional stability between an internal framework 303 and a helmet shell 101.

In some embodiments, the eye shields are designed to prevent eye damage in the construction field. For example, if one eye shield 102 is damaged, another may be utilized thereby increasing user safety.

The mechanisms discussed herein may be implemented in a variety of ways. The embodiments described herein are not limited to construction helmets and may be applicable to other headgear.

Figure 4:
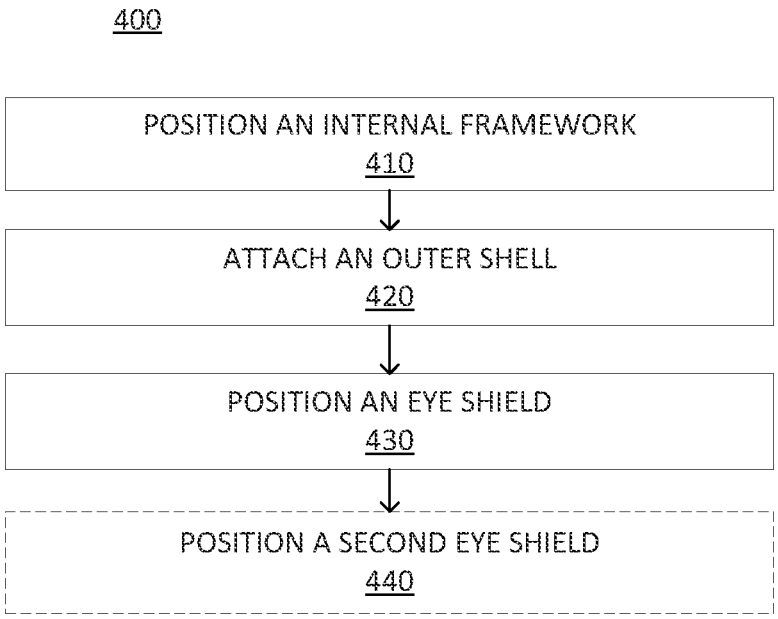
FIG. 4 is flowchart of a method of protecting the eyes of a user, in accordance with one embodiment.

FIG. 4 is a flow diagram 400 of protecting the eyes of a user.

In operation 410, in one embodiment, an internal framework is positioned. In an embodiment, the internal framework 303 is operable to wrap around the head of a user. In an embodiment, the internal framework 303 comprises a stretchable material operable to place around the head of a user.

In operation 420, in one embodiment, an outer shell is attached to said internal framework 303. In one embodiment, the outer shell 101 is coupled to the internal framework 303 with a pivot mechanism 304. In one embodiment, outer shell 101 rotates about the internal framework 303.

In operation 430, in one embodiment, an eye shield is positioned. In an example, an eye shield 102 is positioned between two guide tracks 103 that guide the eye shield 102 in and out of the helmet 100. In one embodiment, the eye shield 102 is curved and guided along an inner surface of an outer shell 101 by guide tracks 103. In one embodiment, as shown in FIG. 2C, guide tracks 103 comprise a pair of grooves 201 along an inner surface of said outer shell 101. These grooves 201 guide a pair of eye shields 102. In various embodiments, a plurality of pairs of eye shields 102 are positioned within helmet 102. Some eye shields 102 may be tinted, some eye shields 102 may be clear. In one embodiment, helmet 101 comprises four sets of pairs of eye shields 102. In such a case, eight eye shields 102 are positioned within helmet 100.

In operation 440, in one embodiment, when included, a second eye shield is positioned. In an embodiment, a second eye shield 102 is positioned on an opposite side of an inner surface of the outer shell 101 from the eye shield 102. One example of this is shown in FIG. 3. In some embodiments, an eye shield 102 and a second eye shield 102 may be deployed together or independently.

In one example, a third eye shield 102 is positioned between the eye shield 102 and the second eye shield 102. In other words, if the eye shield 102 is positioned at the front of a helmet 100, the second eye shield 102 is positioned at the back of the helmet 101. Moreover, a third eye shield 102 is positioned at the side of the helmet 101 between a front eye shield 102 and a second, back eye shield 102. In another example, a fourth eye shield 102 is positioned on an opposite side of the inner surface of the outer shell 101 from the third eye shield 102. In other words, the fourth eye shield 102 is located on a side of the helmet, between the front eye shield 102 and second, back eye shield 102.

Embodiments of the present technology are thus described. While the present technology has been described in particular embodiments, it should be appreciated that the present technology should not be construed as limited by such embodiments, but rather construed according to the following claims.

What is claimed is:

1. An apparatus comprising: an outer shell, wherein said outer shell is rotatable around an internal framework; said internal framework coupled with said outer shell; a first guide track, wherein said first guide track is coupled with an inner surface of a front of said outer shell and disposed between said outer shell and said internal framework; a first eye shield, wherein said first eye shield is guided by a first pair of grooves in said first guide track, said first eye shield is operable to deploy out of and retract into said first guide track at the front of said outer shell and moves between the front of said outer shell and said internal framework, and said first eye shield disposed inside of said front of said outer shell when not deployed; a second guide track, wherein said second guide track is coupled with an inner surface of a back of said outer shell and disposed between said outer shell and said internal framework; and a second eye shield, said second eye shield guided by a second pair of grooves in said second guide track, the second eye shield is made of lead, said second eye shield is operable to deploy out of and retract into said second guide track at the back of said outer shell and moves between the back of said outer shell and said internal framework, and said second eye shield disposed inside of said back of said outer shell when not deployed, the back of the outer shell being opposite the front of the outer shell; a third guide track, wherein said third guide track is coupled with the inner surface of a first side of the outer shell between the first eye shield and the second eye shield; a third eye shield, wherein said third eye shield is guided by a third pair of grooves in said third guide track, said third eye shield is operable to deploy out of and retract into said third guide track and move between the outer shell and said internal framework, and said third eye shield disposed inside of said outer shell when not deployed, the third eye shield is made of a polarized material; a fourth guide track, wherein said fourth guide track is coupled with the inner surface of a second side of the outer shell between the first eye shield and the second eye shield, the second side opposite of the first side; a fourth eye shield, wherein said fourth eye shield is guided by a fourth pair of grooves in said fourth guide track, said fourth eye shield is operable to deploy out of and retract into said fourth guide track and move between the outer shell and said internal framework, and said fourth eye shield disposed inside of said outer shell when not deployed; a fifth eye shield located at the front of the outer shell, the fifth eye shield is paired with said first eye shield in the first guide track, wherein said first pair of grooves guides the first eye shield and the fifth eye shield; a sixth eye shield located at the back of the outer shell, the sixth eye shield is paired with said second eye shield in the second guide track, wherein said second pair of grooves guides the second eye shield and the sixth eye shield; a seventh eye shield located at the first side of the outer shell between the first eye shield and the second eye shield, the seventh eye shield is paired with said third eye shield in the third guide track, wherein said third pair of grooves guides the third eye shield and the seventh eye shield; and an eighth eye shield located at the second side of the outer shell between the first eye shield and the second eye shield, the eighth eye shield is paired with said fourth eye shield in the fourth guide track, wherein said fourth pair of grooves guides the fourth eye shield and the eighth eye shield, each of said first, second, third, fourth, fifth, sixth, seventh and eighth eye shields being individually deployable.

2. The apparatus of claim 1, wherein said first eye shield and said second eye shield are capable of being deployed separately.

3. The apparatus of claim 1, wherein said first eye shield may be retracted while said outer shell is rotated, and wherein said second eye shield may be retracted while said outer shell is rotated.

4. The apparatus of claim 1, wherein said second eye shield is thicker than said first eye shield.

5. A helmet comprising:

an internal framework;

an outer shell, wherein said outer shell is attached to said internal framework with a pivoting mechanism, and wherein said outer shell is rotatable around said internal framework;

a first eye shield disposed at a front of the helmet, said first eye shield is deployable on the front of said helmet, said first eye shield is retractable into the front of said helmet between said outer shell and said internal framework, said first eye shield is retractable while said outer shell rotates, and said first eye shield disposed inside of said front of said helmet when not deployed;

a first pair of guide tracks disposed between said internal framework and said outer shell, said first pair of guide tracks guide said first eye shield;

a second eye shield disposed at a back of the helmet, the second eye shield is made of lead, the second eye shield mounted opposite of said first eye shield, said second eye shield is deployable on the back of said helmet, said second eye shield is retractable into the back of said helmet between a back of said outer shell and said internal framework, said second eye shield is retractable while said outer shell rotates, and said second eye shield disposed inside of said back of said helmet when not deployed;

a second pair of guide tracks disposed between said internal framework and said outer shell on the back of the outer shell, said second pair of guide tracks guide said second eye shield, and the second pair of guide tracks mounted opposite of said first pair of guide tracks;

a third eye shield located at a first side of an inner surface of said outer shell, the first side being between the locations of the first eye shield and the second eye shield on the helmet, the third eye shield is retractable into said helmet between said outer shell and said internal framework, the third eye shield is made of a polarized material, said third eye shield is retractable while said outer shell rotates, and said third eye shield disposed inside of said outer shell when not deployed;

a third pair of guide tracks disposed between said internal framework and said outer shell, said third pair of guide tracks guide said third eye shield;

a fourth eye shield located at a second side of said inner surface of said outer shell, the second side being between the locations of the first eye shield and the second eye shield on the helmet, the second side being opposite of the first side, the fourth eye shield is retractable into said helmet between said outer shell and said internal framework, said fourth eye shield is retractable while said outer shell rotates, and said fourth eye shield disposed inside of said outer shell when not deployed; and a fourth pair of guide tracks disposed between said internal framework and said outer shell, said fourth pair of guide tracks guide said fourth eye shield.

6. The helmet of claim 5, further comprising:

a fifth eye shield located at the front of said helmet and behind said first eye shield, the fifth eye shield is paired with said first eye shield in the first pair of guide tracks, and said first pair of guide tracks comprise a first pair of grooves, wherein said first pair of grooves guide the first eye shield and the fifth eye shield;

a sixth eye shield located at the back of said helmet and behind said second eye shield, the sixth eye shield is paired with said second eye shield in the second pair of guide tracks, and said second guide track comprise a second pair of grooves, wherein said second pair of grooves guide the second eye shield and the sixth eye shield;

a seventh eye shield located at the first side of said helmet and behind said third eye shield, the seventh eye shield is paired with said third eye shield in the third pair of guide tracks, and said third guide track comprise a third pair of grooves, wherein said third pair of grooves guide the third eye shield and the seventh eye shield; and an eighth eye shield located at the second side of said helmet and behind said fourth eye shield, the eighth eye shield is paired with said fourth eye shield in the fourth pair of guide tracks, and said fourth guide track comprise a fourth pair of grooves, wherein said fourth pair of grooves guide the fourth eye shield and the eighth eye shield; and each of said first through said eighth eye shields being individually deployable.

* * * * *